United States Patent [19]

Yamamoto et al.

[11] Patent Number: 4,774,990

[45] Date of Patent: Oct. 4, 1988

[54] HIGH PRESSURE CASTING METHOD AND A CASTING CORE

[75] Inventors: Yukio Yamamoto; Shunzo Takasuga, both of Hiroshima; Fujio Ueoka, Yamaguchi; Norio Kodama, Hiroshima, all of Japan

[73] Assignee: Mazda Motor Corporation, Hiroshima, Japan

[21] Appl. No.: 81,026

[22] Filed: Aug. 3, 1987

[30] Foreign Application Priority Data

Aug. 4, 1986 [JP] Japan ..... 61-183218
Aug. 4, 1986 [JP] Japan ..... 61-119623[U]

[51] Int. Cl.[4] ..... B22C 3/00

[52] U.S. Cl. ..... 164/14; 164/33; 164/132; 164/137; 164/138; 164/369

[58] Field of Search ..... 164/138, 14, 28, 23, 164/24, 369, 370, 33, 516–519, 137, 132, 351, 365, 368; 106/38.28

[56] References Cited

U.S. PATENT DOCUMENTS

| | | | |
|---|---|---|---|
| 2,809,117 | 10/1957 | Waterhouse | 106/38.28 |
| 3,266,106 | 8/1966 | Lirones | 164/518 X |

FOREIGN PATENT DOCUMENTS

| | | | |
|---|---|---|---|
| 53-57123 | 5/1978 | Japan | 164/138 |
| 56-68548 | 6/1981 | Japan | 164/369 |
| 58-20348 | 2/1983 | Japan | 164/137 |
| 60-15418 | 4/1985 | Japan . | |
| 865482 | 9/1981 | U.S.S.R. | 164/138 |

*Primary Examiner*—Kuang Y. Lin
*Attorney, Agent, or Firm*—Burns, Doane, Swecker & Mathis

[57] ABSTRACT

A casting core adapted to be placed inside a molding cavity for defining a cored-out hollow inside a metal casting, which core comprises a first coated layer formed on an exterior surface of the casting core by coating a slurry containing powdery refractory material, and a second coated layer formed over the first coated layer by applying a solution containing graphite particles. A method of making a metal casting with the use of the casting core is also disclosed.

5 Claims, 3 Drawing Sheets

HIGH PRESSURE CASTING METHOD AND A CASTING CORE

BACKGROUND OF THE INVENTION

1. Field of the Invention

The present invention relates to a high pressure casting method such as, for example, a die casting method, for making an article of manufacture having a shaped hollow defined therein, and a casting core used in the practice of the high pressure casting method and having a shape complemental to the shape of the hollow in the article of manufacture.

2. Description of the Prior Art

It is well know that, in the practice of the high pressure casting method, for example, the die casting method for making an article of manufacture having a shaped hollow defined therein, a casting core complemental in shape to the shape of the hollow in the article of manufacture is used. The casting core is generally in the form of a compressed sand block that can be disintegrated, after the article of manufacture has been molded, so as to leave the complemental hollow inside the resultant article of manufacture. Numerous methods of making the casting core are well known, and, where during the practice of the die casting method a high pressure is used to inject molten metal, for example, molten aluminum, into a mold assembly, core sands are integrated together by the use of a core binder to complete the casting core. An example of the core making methods is disclosed in the Japanese Patent Publication No. 60-15418, published Apr. 19, 1985.

In general, during the casting of the article of manufacture having the hollow defined therein (which hollow is hereinafter referred to as a cored-out hollow, the article of manufacture having the cored-out hollow being referred to as a hollow article, for the sake of brevity) with the use of the sand core supported inside the mold assembly, molten metal injected into the mold assembly under pressure fills up a gap between the sand core and the wall of the mold assembly defining a mold cavity, contacting the outer surface of the sand core. It has often been experienced that sand inclusion occurs in the wall of the hollow article defining the cored-out hollow as a result of sand particles sticking to the molten metal then solidified. The inclusion of sand particles in the wall of the hollow article defining the cored-out hollow poses numerous problems. By way of example, where the hollow article is an automobile engine cylinder head, the sand particles would contaminate lubricant oil and/or a cooling water circulated in the cylinder head.

In view of the foregoing, the sand core disclosed in the previously mentioned Japanese publication has inner and outer coatings applied over the outer surface of the sand core. The inner coating is formed by applying and drying an aqueous slurry of powdery refractory material, for example, silica flour, zircon flour or mullanite flour, and colloidal silica containing 20 to 30% silica. The outer coating subsequently formed over the inner coating is formed by applying and drying and aqueous solution of artificial mica containing sodium, fluorine and silicon with or without lithium and capable of exhibiting fluidity when in contact with water. The aqueous slurry for the inner coating is of a composition containing 50 liters of water, 5 kg of colloidal silica containing 30% silica, 0.5 kg of a wetting agent (sodium dialkylsulfonesuccinate), 0.1 kg of a defoaming agent, 100 kg of zircon flour of 10 micron in particle size and 40 kg of zircon flour of 1 micron in particle size.

The aqueous solution for the outer coating is of a composition containing 15 liters of water, 30 kg of an aqueous solution of 15% artificial mica, 0.9 kg of the same wetting agent and 0.12 kg of a defoaming agent, or of a composition containing 30 liters of water, 30 kg of the aqueous solution of the artificial mica, 0.9 kg of the wetting agent, 0.12 kg of the defoaming agent and 3 kg of metallic aluminum powder.

According to the above mentioned Japanese publication, the inner coating is utilized to impart a smoothness to the surface of the wall defining the cored-out hollow in the resultant hollow article while, during the casting, acting to distribute the pressure of the molten metal being injected substantially uniformly over the surface of the sand core. The outer coating is utilized to prevent the molten metal under pressure from penetrating into interstices in the sand core during the casting.

It is, however, been found that, since particles of the mica used as a principal component of the outer coating do not exhibit a satisfactory dispersibility in the aqueous solution, the mica particles cannot be distributed uniformly in the outer coating. Moreover, the particle size of the mica is relatively great so much as to result in drooping of the coating material, constituting an additional cause of the uneven distribution of the mica particles in the outer coating.

The uneven distribution of the mica particles in the outer coating would result in uneven shrinkage of the outer coating during the subsequent drying process, which in turn constitutes a cause of occurrence of crackings in the outer coating. As a matter of course, the presence of crackings in the outer coating of the sand core permits molten metal to penetrate internally of the sand core during the casting process.

Even though the resin-coated sand core is successfully prepared with no cracking occurring in the outer coating, the outer coating tends to be susceptible to cracking during the casting process by the effect of a high pressure under which molten metal is poured into the mold cavity. In particular, where the resin-coated sand core has recesses in its shape, the outer coating is sensitive to shrinkage crack and, therefore, when such a resin-coated sand core is used in the practice of the high pressure casting technique, the frequency of occurrence of cracks in the outer coating tends to increase.

Moreover, when the resin-coated sand core is removed subsequent to the casting which has been carried out under these circumstances, there is a relatively high possibility that particles of one or both of the mica and the sand material forming the core may remain sticking to the wall defining the cored-hollow in the hollow article. The practical use of the hollow article so prepared as, for example, an automobile engine cylinder head poses a problem the use of the sand core in which no mica coating as a penetration preventing layer is formed, the sand and/or mica particles would contaminate a lubricant oil and/or a cooling water circulated in the cylinder head.

SUMMARY OF THE INVENTION

The present invention has been devised with a view to substantially eliminating the above described problems and has for its essential object to provide an improved high pressure casting method effective to minimize or substantially eliminate the occurrence of the shrinkage crack in the casting core even though a high pressure is used to pour molten metal, preferably, molten aluminum, into the molding cavity in which the casing core is situated.

Another important object of the present invention is to provide an improved high pressure casting method of the type referred to above, which is effective to provide the resultant hollow article wherein the wall defining the cored-out hollow is smooth with no foreign particles substantially included.

It is a related object of the present invention to provide an improved casting core utilizable in association with the high pressure casting method in which a relatively high pressure is used for pouring molten metal into the molding cavity.

According to a preferred embodiment of the present invention herein disclosed, a hollow article having a cored-out hollow defined therein can be advantageously prepared by the use of a casting core which is a replica of the cored-out hollow. The casting core has an inner coating, which is formed by applying a slurry of powdery refractory material over the entire surface thereof, and an outer coating which is formed by applying an aqueous solution of graphite particles subsequent to the drying of the inner coating and then drying the applied solution.

The casting core so formed is then placed inside the molding cavity defined by mating dies clamped together, and molten metal is subsequently poured under high pressure into the molding cavity. Upon the solidification of the molten metal so poured into the molding cavity, the resultant casting is removed together with the casting core out of the molding cavity and the casting core is then removed from the casting thereby leaving the hollow article having the cored-out hollow defined therein. The removal of the casting core from the casting may be carried out by allowing the coating core to contact water so that it can be disintegrated.

In the practice of the method according to the present invention, the graphite particles forming a principal component of the outer coating have a particle size smaller than that of the mica particles used in the prior art and can exhibit such a characteristic as to withstand a relatively high casting pressure. Therefore, as compared with the outer coating formed with the use of the mica particles, the graphite particles can be substantially uniformly distributed in the outer coating with the consequence that not only the formation of cracks resulting from irregular shrinkage of the outer coating which would occur when the latter is heated during the formation of the outer coating, that is, during the drying of the applied solution to form the outer coating, but also the formation of cracks by the effect of the pressure under which molten metal is poured into the molding cavity can be minimized, thereby minimizing any possible penetration of molten metal into the casting core so that the hollow article having a smooth wall defining the cored-out hollow can be obtained.

In addition, particularly where the molten metal poured into the molding cavity is aluminum, the graphite particles contained in the outer coating react with aluminum to form aluminum carbide when the molten aluminum is brought into contact with the outer coating. Since the aluminum carbide is readily reactive with water, and when the resultant casting with the casting core therein is, after having been removed out from the mold assembly, allowed to contact water, the aluminum carbide reacts with water to corrode with the consequence that the casting core inside the casting can readily removed out of the casting without any particles adhering to the wall of the casting defining the cored hollow.

According to another preferred embodiment of the present invention, there is provided the casting core of two-component type comprising first and second core members which, when combined together, represents a replica of the cored-out hollow desired to be defined in the hollow article. In this case, each of the first and second core members has an inner coating formed by applying and drying the slurry of powdery refractory material an also an outer coating formed by applying and drying an aqueous solution of fine or flaky particles of graphite. A joint formed between the first and second core members when the both are combined together to provide a complete casting core is, according to the present invention, sealed by a sealing layer operable to avoid any possible ingress of molten metal during the actual casting. The composition of the sealing layer may be identical with the composition of the outer coating. Alternatively, the composition of the sealing layer may be an aqueous solution of either mica or water glass (sodium silicate).

With the sealing layer formed at the joint between the first and second core members, any possible formation of casting fins which would protrude inwardly of the cored hollow from the wall defining the cored hollow can be substantially avoided.

BRIEF DESCRIPTION OF THE DRAWINGS

These and other objects and features of the present invention will become readily understood from the following detailed description thereof taken in conjunction with preferred embodiments thereof with reference to the accompanying drawings, in which.

DETAILED DESCRIPTION OF THE EMBODIMENT

Figure 1:
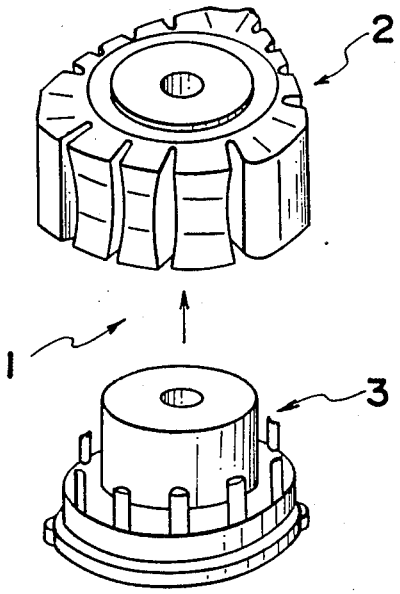
FIG. 1 is a perspective view showing a casting core of two-piece construction designed to make a generally triangular rotor in a rotary engine.
Figure 2:
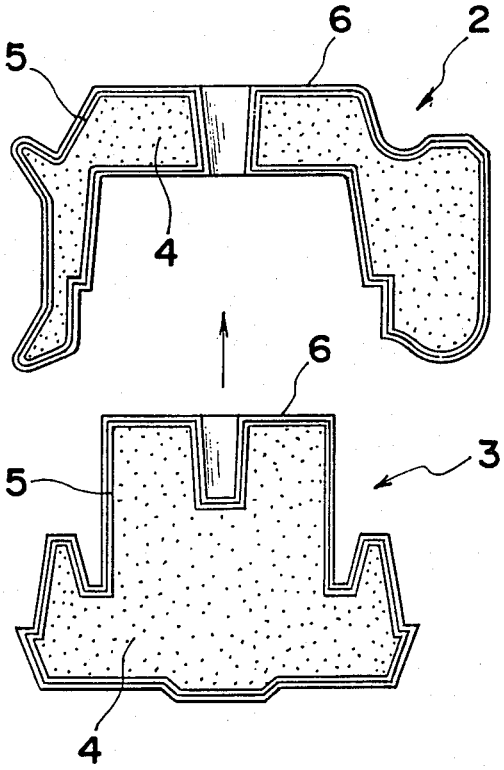
FIG. 2 is a side sectional view, on an enlarged scale, of the casting core shown in FIG. 1.
Figure 5:
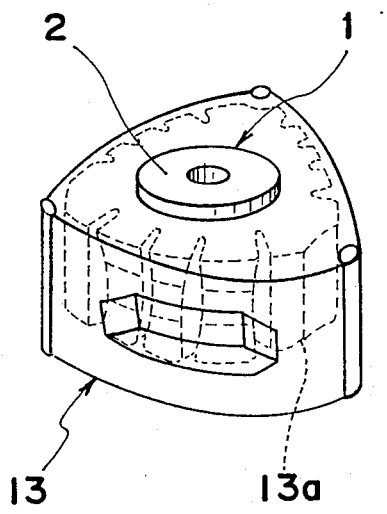
FIG. 5 is a perspective view of the rotor cast according to the method of the present invention and with the use of the casting core according to the present invention.

Referring first to FIGS. 1, 2 and 5, in making a generally triangular rotor 13 for a rotary internal combustion engine also known as Wankel engine, the present invention makes use of a split-type casting core 1 which comprises a first core member 2, having a recess defined therein, and a second core member 3 having a projection formed integrally therewith and being complemental in shape to the shape of recess in the first core member 2. While the first and second core members 2 and 3 may have either a different shape or an identical shape, these first and second core members 2 and 3, when combined together with the projection in the second core member 3 received in the recess in the first core member 2, permit the resultant casting core 1 to represent an appearance complemental to the shape of a hollow, or a cored-out hollow, 13*a* desired to be eventually defined in the rotor 13.

Each of the first and second core members 2 and 3 is in the form of a block 4 of resin-coated stands, for example, 200 meshes in particle size, integrated with a phenol resin used as a binder. The resin-coated sand block 4 can be formed by molding a mass of resin-coated sands with the use of a core box heated to a temperature of, for example, about 250° C.

In accordance with the present invention, each of the first and second core members 2 and 3 is exteriorly coated to have inner and outer coated layers 5 and 6 one above the other. Since the inner coated layers 5 on the respective first and second core members 2 and 3 are of the same composition and the outer coated layers 6 on the respective first and second core members 2 and 3 are of the same composition, reference will be made only to one of the first and second core members, for example, the first core member 2, in the following description for the sake of brevity so far as the respective compositions of the inner and outer coated layers 5 and 6 are concerned.

As best shown in FIG. 2, the inner coated layer 5 has a thickness within the range of, for example, 100 to 350 micrometers, and is formed by applying a slurry of powdery refractory material over the entire surface of the sand block 4 and then drying the applied slurry for 20 to 30 minutes at a drying temperature within the range of 100° to 150° C. If the thickness of the inner coated layer 5 is smaller than 100 micrometers, cracking would occur under the influence of a pressure at which molten metal is injected into a molding cavity in the die assembly during the subsequent casting operation. On the other hand, if the thickness of the inner coated layer 5 is greater than 350 micrometers, an extra effect of avoiding the penetration of molten metal into the sand block 4 which is proportional to the increased thickness of the inner coated layer 5 cannot be obtained and the dimension of the core member 2 would be adversely affected.

The slurry used to form the inner coated layer 5 is of a composition containing 20 to 75 wt. % of powdery refractory material which may be at least one of 0 to 75 wt. % of $SiO_2$, 0 to 20 wt. % of $Al_2O_3$ and 0 to 95 wt. % of $Fe_2O_3$ with or without the addition of one or a mixture of fine powder of Mg0, $ZrO_2$ and others, the percent of weight being relative to the total weight of the slurry. A preferred composition of the slurry is 55.5 wt. % of $SiO_2$; 2.0 wt. % of $Al_2O_3$; 4.0 wt. % of $Fe_2O_3$; 0.5 wt. % of CaO; 25.0 wt. % of MgO; 0.5 wt. % of $ZrO_2$; 6.0 wt. % of C; and 6.5 wt. % of others, which is diluted with ethyl alcohol to 50%.

The powdery refractory material is preferred to have an average particle size not greater than 300 meshes, that is, not greater than 40 micrometers.

Figure 7:
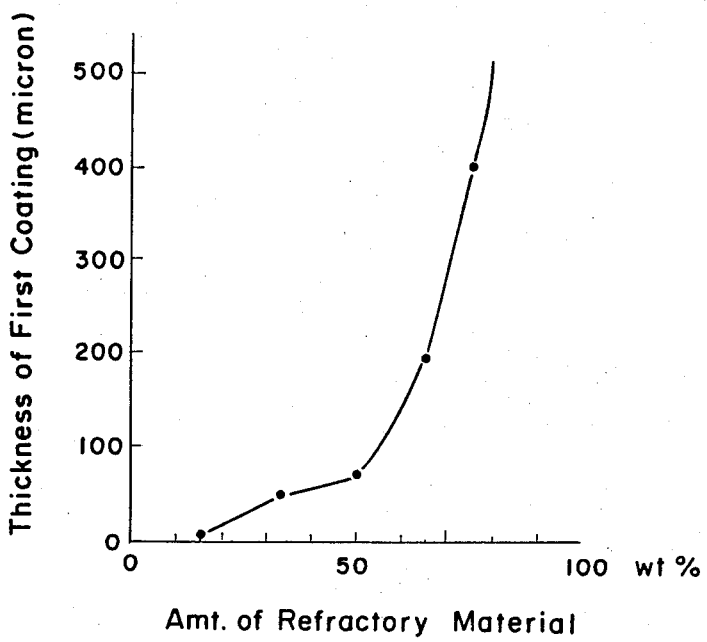
FIG. 7 is a graph showing the relationship between the thickness of a first coating, i.e., an inner coated layer, on the casting core and the amount of powdery refractory material contained in a slurry used to form the inner coated layer.

Hereinafter, the reason for the limitation of the content of the powdery refractory material to 20 to 75 wt. % will be discussed with particular reference to FIG. 7. If the content of the powdery refractory material in the alcohol-diluted slurry is smaller than the lower limit of 20 wt. %, the amount of refractory particles that can be deposited on the surface of the sand core will be small, making it difficult to form the first coating of the required thickness.

Figure 8:
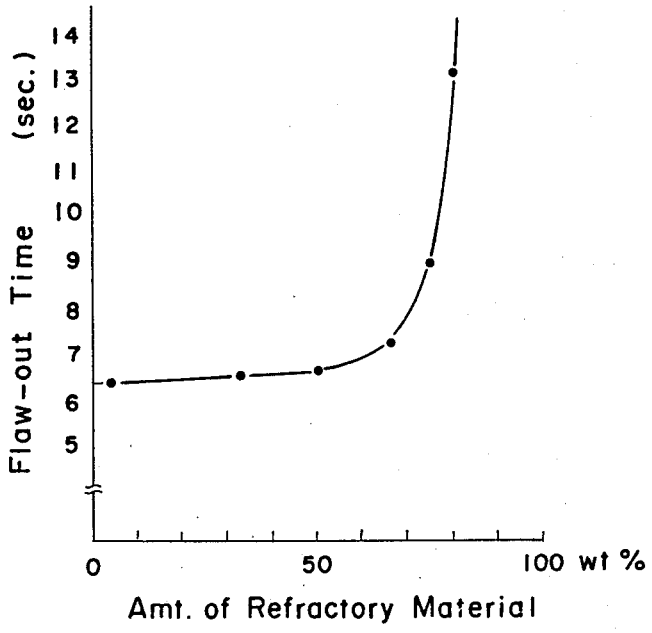
FIG. 8 is a graph used to explain the viscosity of the slurry for the formation of the inner coated layer on the casting core.

On the other hand, if the content of the powdery refractory material in the slurry exceeds the upper limit of 75 wt. %, the viscosity of the slurry as a whole tends to increase rapidly as evidenced in the graph of FIG. 8 and deviation in viscosity of the slurry tends to be so considerable as to result in difficulty in maintaining a required viscosity. In addition, the excess of the content of the powdery refractory material over the upper limit brings about the increased amount of the refractory particles deposited on the sand core with the thickness of the resultant first coating varying from position to position on the sand core. It is to be noted that, in FIG. 8, the viscosity of the slurry is expressed in terms of the time required for a predetermined amount of the slurry of the above described composition to flow by gravity out of a viscosity metering cup of predetermined volume as shown in FIG. 9, which time is plotted against the particular content of the powdery refractory material in the slurry.

Figure 9:
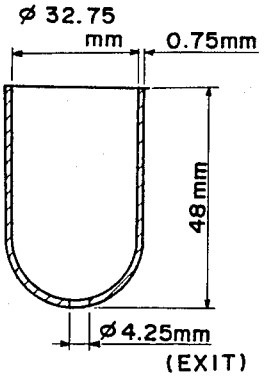
FIG. 9 is a sectional representation of a ZAHN Viscosity cup used to determine the viscosity of the slurry in terms of the flow-out time required for the slurry to flow out of the cup.

Specifically, referring to FIG. 9, the viscosity metering cup used for the measurement of the viscosity in terms of the flow-out time is referred to as a #4 ZAHN Viscosity Cup of a construction shown therein having a generally cylindrical body, 32.75 mm in inner diameter, the bottom of which is downwardly rounded and has an flow exit opening of 4.25 mm in diameter, the wall forming the cup having a thickness of 0.75 mm. The cup has a volume of 400 cc and the height of 48 mm as measured from the end of the cylindrical body opposite the exit opening to the rounded bottom thereof as indicated in FIG. 9. The measurement is carried out at room temperature of 20° C.

The content of the powdery refractory material in the slurry according to the present invention may be calculated in terms of the density of the powdery refractory material contained in the slurry, which density can be obtained in terms of percent by weight by dividing the total weight of the slurry by the sum of the weight of the slurry plus the weight of the liquid used to dilute the slurry.

After the inner coated layer 5 has been dried, an aqueous solution containing 10 to 50 wt. % (relative to the total weight of the aqueous solution) of globular or flaky particles of graphite having an average particle size within the range of 0.5 to 10 micrometers, preferably 0.5 to 2 micrometers, is applied over the inner coated layer 5 and is then dried to form the outer coated layer 6 of a thickness within the range of 10 to 50 micrometers, preferably 15 to 50 micrometers. The thickness of the outer coated layer 6 is so chosen because, if it is smaller than the lower limit of 10 micrometers, cracking would occur during the casting operation under the influence of the pressure at which molten metal is injected into the molding cavity, but if it is greater than the upper limit of 50 micrometers, no extra effect of preventing any possible penetration of molten metal into the sand core 4, which should be proportional to the increased thickness of the outer coated layer 6, can be obtained.

The upper and lower limits of the average particle size of the graphite particles as defined above are chosen due to considerations associated with the manufacture. In particular, if the average particle size is smaller than the lower limit of 0.5 micrometer, the manufacture will become difficult, but if the average particle size exceeds the upper limit of 10 micrometers, the layer cannot be densified accompanied by the possibility of penetration of molten into the sand block 4 during the casting operation.

The graphite used to form the aqueous solution may be in the form of either flaky graphite particles or globular graphite particles, the flaky graphite particles being preferred because the substantially increased penetration preventive effect can be obtained.

The amount of the graphite contained in the aqueous solution necessitated to form the outer coated layer 6 is chosen within the range of 10 to 50 wt. % relative to the total weight of the aqueous solution because, if it is smaller than the lower limit of 10 wt. %, the density of the graphite in the aqueous solution is too low for the thickness of the outer coated layer 6, formed in a single dip or application of the aqueous solution, to be small. On the other hand, if the amount of the graphite contained in the aqueous solution is greater than the upper limit of 50 wt. %, the density tends to be come too high for the thickness of the resultant outer coated layer 6 to become irregular.

Any one of the applied slurry and the applied aqueous solution to form the inner and outer coated layers 5 and 6, respectively, may be dried at, for example, 100° C. for about 20 minutes. However, any suitable drying conditions may be employed depending on the kind of the volatile component contained in the slurry or the aqueous solution. In other words, any suitable drying temperature and drying time can be employed in consideration of the kind of the volatile component contained in the slurry and the aqueous solution.

For the manufacture of the generally triangular rotor 13 of FIG. 5 for the rotary internal combustion engine, the inner coated layer 5 is preferred to have a thickness of 150 micrometers and the outer coated layer 6 is preferred to have a thickness of 30 micrometers.

Figure 3:
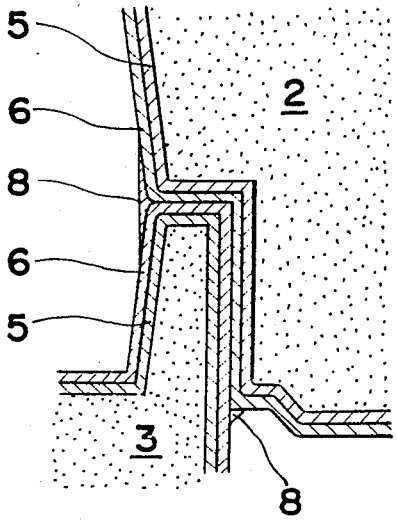
FIG. 3 is a fragmentary side sectional view, on a further enlarged scale, of a portion of the casting core showing a joint between the two core members thereof.
Figure 4:
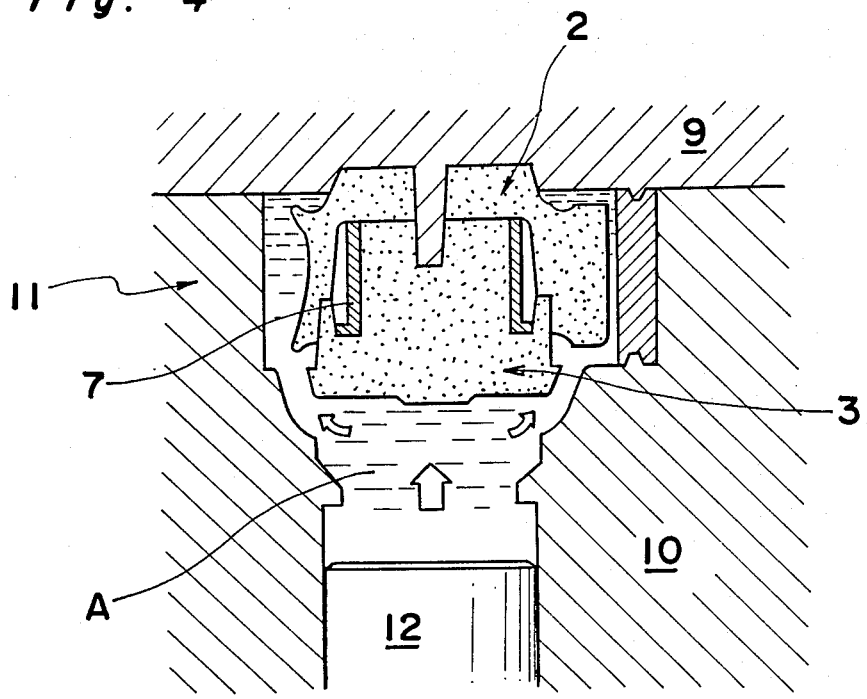
FIG. 4 is a schematic side sectional view of a die assembly with the casting core situated therein, showing a method of casting the rotor.

While each of the first and second core members 2 and 3 has the inner and outer coated layers 5 and 6 deposited on the entire surface thereof in overlapped relationship as hereinbefore described, the first and second core members 2 and 3 are combined together with the projection integral with the second core member 3 received in the recess in the first core member 2 to complete the split-type casting core 1 as shown in FIG. 4. A circumferential joint between the first and second core members 2 and 3 is interiorly and exteriorly applied with a sealing material to form respective sealing layers, shown by 8 in FIG. 3, for avoiding any possible ingress of molten metal through the joint during the high pressure casting operation.

The sealing material may be identical with the aqueous solution of graphite particles, or alternatively it may be an aqueous solution of either flaky or fine mica particles or particles of water glass. The sealing material is applied interiorly and exteriorly so as to form the respective sealing layers 8 when the applied sealing material is subsequently dried. Where the same material as the aqueous solution for the outer coated layer 6 is used as the sealing material, it should be applied so that the resultant sealing layers 8 may have a thickness equal to the thickness of the outer coated layer 6. On the other hand, where the mica particles are used for the sealing material, they should have an average particle size of 2 to 10 microns and should be applied so that the thickness of the resultant sealing layers 8 may have a thickness within the range of 50 to 150 micrometers.

After the application of the sealing material, the applied sealing material is dried under drying conditions similar to that used for drying the outer coated layer 6.

It is to be noted that, when the first and second core members 2 and 3 are to be combined together in the manner as hereinabove described and before the resultant casting core 1 is placed inside the molding cavity as will be described later, a reinforcement member 7 is interposed between the first and second core members 2 and 3 as shown in FIG. 4 with the first and second core members 2 and 3 positioned upwardly and downwardly relative to each other.

During the casting operation, as best shown in FIG. 4, the casting core 1 is placed inside the molding cavity defined in a mold assembly 11 comprised of upper and lower dies 9 and 10. The mold assembly 11 includes a hydraulically or electrically operated plunger 12 used to inject a molten aluminum alloy A, for example, molten aluminum alloy specified JIS.AC8A (Si: 11.0%, Cu: 3.2%, Mg: 0.4%, Ti: 0.08%, Zn: 0.03%, Sb: 0.15%, and the balance being Al) according to the Japanese Industrial Standards (JIS), at a predetermined pressure of 700 $kg/cm^2$ into the molding cavity so as to encompass the casting core 1.

After the molten metal A encompassing the casting core 1 has been solidified, the casting together with the casting core 1 is removed out of the molding cavity and the casting core 1 is then flushed out of the casting in a manner which will now be described. The removal of the solidified casting out of the molding cavity can readily be accomplished by separating the upper and lower dies 9 and 10 away from each other in a manner well known to those skilled in the art.

The removal of the casting core 1 out of the casting is carried out by immersing the casting together with the casting core 1 in water for about 1 to 2 hours to allow the casting core 1 to be disintegrated. The disintegration of the casting core 1 can readily be achieved because the graphite particles contained in the outer coated layer 6 has reacted with aluminum to form aluminum carbide when the molten aluminum alloy was brought into contact with the outer coated layer 6 and because the aluminum carbide so formed reacts with water to corrode, allowing the casting core inside the casting to be readily disintegrated.

The disintegrated core sands can be removed out of the casting so as to leave the cored-out hollow **13*a* in the generally triangular rotor 13, by applying external forces, for example, vibratory motion or jets of water, to the disintegrated core sands remaining inside the casting so that the disintegrated sands can flow out of the casting, thereby completing the generally triangular rotor 13 having the cored-out hollow 13*a* as shown in FIG. 5. In this way, the disintegrated core sands which have previously formed the casting core 1 can be substantially completely removed out of the casting with no substantial possibility of graphite particles of the outer coated layer 6 adhering to the wall defining the cored-out hollow 13***a* in the rotor 13.

It is, however, to be noted that the step of immersing the casting together with the casting core 1 therein in the water as described above may not be always necessary in carrying out the removal of the casting core 1 and can therefore be dispensed with. In such case, the casting core 1 inside the casting can readily be disintegrated when subjected to vibrations or when water is jetted at the casting core 1 inside the casting.

Hereinafter the relationship between the casting pressure, at which the molten aluminum alloy A is injected into the molding cavity, and the depth of penetration of the molten aluminum alloy A into the casting core 1 through one or both of the outer and inner coated layers 5 and 6 will be discussed with particular reference to FIG. 6.

Figure 6:
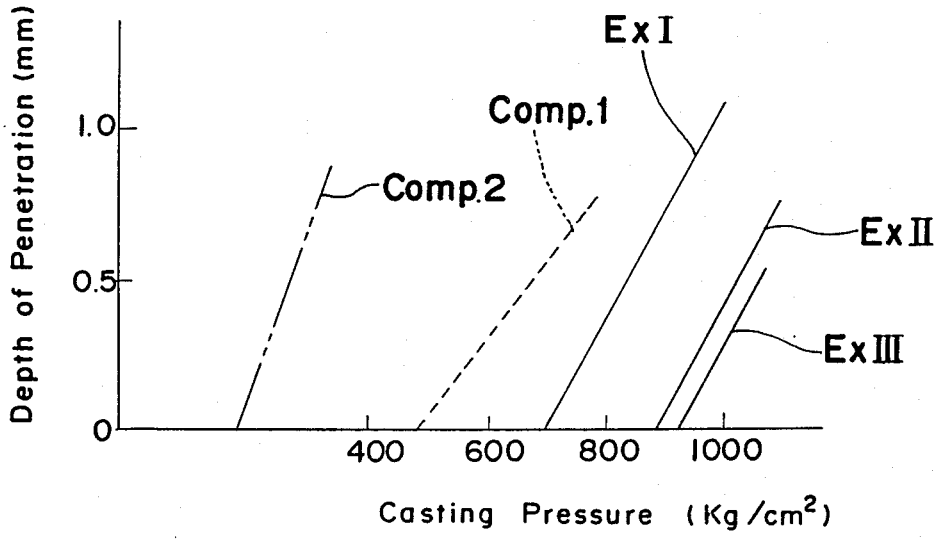
FIG. 6 is a graph showing the relationship between the depth of penetration of molten metal into the casting core and the casting pressure used to pour the molten metal into the die assembly.

Referring to FIG. 6, the dotted line identified by Comp. 1 illustrates the case with the casting core having the outer coated layer of 100 micrometers in thickness made of mica particles of 3 micrometers in average particle size. The double-dotted chain line identified by Comp. 2 illustrates the case with the casting core having the outer coated layer of 5 micrometers in thickness made of graphite particles. The solid line identified by Ex. I illustrates the case with the casting core having the outer coated layer of 10 micrometers in thickness made of flaky graphite particles of 1 micrometer in average particle size; the solid line identified by Ex. II illustrates the case with the casting core having the outer coated layer of 30 micrometers in thickness made of flaky graphite particles of 1 micrometer in average particle size; and the solid line identified by Ex. III illustrates the case with the casting core having the outer coated layer of 50 micrometers in thickness, it being to be noted that the casting cores under Exs. I to III pertain to specific examples of the present invention.

In all of these casting cores under Comps. 1 and 2 the Exs. I to III, the casting core is molded with the use of #200 shell sands and the inner coated layer positioned underneath the outer coated layer is deposited to an equal thickness of 150 micrometers.

From the graph presented in FIG. 6, it will readily be seen that, in the case of the casting core under Comp. 2, even though the outer coated layer 6 is formed by applying and drying the aqueous solution of graphite particles, the departure of the thickness of the outer coated layer 6 from the lower limit of the range of thickness according to the present invention results in that, during the actual casting with the casting pressure being, for example, about 250 kg/cm$^2$, the molten aluminum alloy has penetrated 0.3 mm into the casting core 1 through the total thickness of 0.15 mm of the outer and inner coated layers 6 and 5. A similar penetration takes place in the casting core under Comp. 1 when the casting pressure reaches about 600 kg/cm$^2$ with the molten aluminum alloy having penetrated through the total thickness of 0.25 mm of the outer and inner coated layers 6 and 5.

In contrast thereto, in the case of the casting core under Ex. I according to the present invention, when the casting pressure of 700 kg/cm$^2$ which is a predetermined casting pressure utilized in the practice of the present invention for pouring the molten aluminum alloy A into the molding cavity, no molten aluminum alloy has not yet penetrated into the casting core and, therefore, the outer coated layer 6 of a thickness smaller than that of the casting core under Comp. 1 has exhibited a satisfactory penetration preventive effect. The use of the relatively thin outer coated layer 6 enables the casting core 1 to be precisely prepared to the required or desired dimensions.

The casting core under Ex. II is such that, before the casting pressure reaches about 950 kg/cm$^2$ higher than the predetermined casting pressure, the molten aluminum alloy does not penetrate completely through the total thickness, 0.18 mm, of the outer and inner coated layers 6 and 5 and, accordingly, at the predetermined pressure of 700 kg/cm$^2$, no penetration of the molten aluminum alloy through the outer and inner coated layers 6 and 5 take place, showing that, as compared with the case Ex. I, the outer coated layer 6 in the casting core under Ex. II has a relatively high penetration preventive effect.

A similar description as that made in connection with the case Ex. II applies to the case Ex. III in which the maximum permissible thickness is employed for the outer coated layer 6 according to the present invention.

Separately from the tests conducted to determine the relationship between the depth of penetration and the thickness of the outer coated layer overlaying the inner coated layer on the individual casting core, study has been made to determine the maximum variation of the thickness of the outer coated layer subsequent to the complete formation, that is, drying, of the outer coated layer. This study has indicated that the case Comp. 1 and the case Ex. I exhibit 50 micrometers and 5 micrometers in maximum variation of the thickness of the outer coated layer. Therefore, as compared with the case Comp. 1 in which the relatively great thickness is employed in the outer coated layer, the relatively thin outer coated layer on the casting core under Ex. I has exhibited a relatively small variation and the use of the graphite particles as a material for the outer coated layer is effective to provide the casting core 1 which is stable in dimension, is capable of withstanding a relatively high casting pressure and has a minimized possibility of occurrence of cracking even though the thickness of the outer coated layer is relatively small. This also illustrates that, for a given resistance to pressure, the relatively thin graphite-coated layer (outer coated layer under Ex. 1) permits the use of a smaller radius of curvature than the relatively thick mica-coated layer (outer coated layer under Comp. 1) and, as compared with the case Comp. 1, the case Ex. 1 brings about such an advantage that, when the casting core is assembled, for example, by combining the separate core members together, the effect of preventing the molten metal from penetrating into the casting core through the joint between the core members can be advantageously enhanced.

Another study has also been conducted to determine the presence or absence of exfoliation of the outer coating layer in each of the casting cores under Comp. 1 and Ex. 1 each having defined therein a recess of 50 mm in radius of curvature. The result of this study has indicated that exfoliation of the outer coated layer has occurred in the casting core under Comp. 1, but no exfoliation of the outer coated layer have occurred in the casting core under Ex. 1. Accordingly, if the high pressure casting is carried out under these circumstances, there will be a high possibility of occurrence of cracking in the outer coated layer in the casting core under Comp. 1 with the consequence that the molten metal A will penetrate into the casting core considerably, whereas the possibility of occurrence of cracking in the outer coated layer in the casting core under Ex. 1 can be advantageously minimized and, therefore, any possible penetration of the molten metal A into the casting core can advantageously be minimized. Thus, while when the high pressure casting is performed with the use of the casting core under Comp. 1 in which the thickness of the outer-coated layer varies considerably and the outer coated layer is susceptible to exfoliation, cracking tends to occur in the outer coated layer and the molten metal A tends to easily penetrate into the casting core, the present invention such as represented by Ex. 1 is effective to assuredly avoid any possible penetration of the molten metal A into the casting core thereby to make it possible to manufacture the rotor 13 having a good casting surface, since the variation of the thickness of the outer coated layer is minimized and the outer coated layer is hard to exfoliate as hereinbefore discussed.

Although the present invention has been fully described in connection with the preferred embodiment thereof with reference to the accompanying drawings, it is to be noted that various changes and modifications are apparent to those skilled in the art. By way of example, although each of the core members forming the casting core has been described as formed with the use of resin-coated sands, the material for each of the core members may not be limited to that illustrated, but may be cement sands, self-hardening sands or gypsum.

Also, although the casting core has been shown and described as composed of the separate core members, that is, reference has been made to the use of the casting core of two-piece construction, it is not always essential and any casting core of one-piece or three-piece construction may be employed.

In describing the preferred embodiment of the present invention, reference has been made to the casting of the generally triangular rotor for the rotary internal combustion engine. However, the present invention can be equally applicable to the casting of any article of manufacture such as, for example, an engine cylinder block or head, or any other component parts of an automobile.

Important of all is that, instead of the graphite particles for the outer coated layer, mica may be equally employed. Where an aqueous solution of fine or flaky mica particles is employed for forming the outer coated layer, the average particle size of the mica particles should be within the range of 2 to 10 microns and the thickness of the resultant outer coated layer should be within the range of 50 and 150 micrometers. In addition, the aqueous solution of mica particles may contain 80 wt. % of mica particles and 20 wt. % of sodium silicate.

Accordingly, such changes and modifications are to be understood as included within the scope of the present invention as defined by the appended claims.

We claim:

1. A method of making a metal casting having a cored-out hollow defined therein, which method comprises the steps of:

preparing a casting core complemental in shape to the shape of the cored-out hollow, said casting core being formed by packing refractory material;

applying to an exterior surface of the casting core a slurry containing powdery refractory material;

drying the applied slurry to form a first coated layer;

applying externally over the first coated layer an aqueous solution containing flaky graphite particles, wherein the graphite particles have an average particle size within the range of 0.5 to 2 micrometers;

drying the applied aqueous solution to form a second coated layer thereby to complete the casting core, wherein the second coated layer has a thickness within the range of 10 to 50 micrometers;

placing the casting core, having the first and second coated layers deposited thereon, inside a molding cavity;

pouring a molten metal of aluminum alloy into the molding cavity under pressure to form the metal casting;

removing the metal casting together with the casting core out of the molding cavity;

causing the casting core inside the metal casting to contact water; and removing the casing core out from the metal casting, thereby leaving the cored-out hollow inside the metal casting.

2. The method as claimed in claim 1, wherein the amount of the powdery refractory material is within the range of 20 to 75 wt. % relative to the total weight of the slurry.

3. The method as claimed in claim 1, wherein the amount of the graphite particles is within the range of 10 to 50 wt. % relative to the total weight of the solution.

4. A casting core adapted to be placed inside a molding cavity for defining a cored-out hollow inside a metal casting, which core comprises a shaped body made of refractory particles, a first coated layer formed on an exterior surface of the shaped body and made of refractory material, and a second coated layer formed over the first coated layer and made of flaky graphite particles having an average particle size within the range of 0.5 to 2 micrometers, said second coated layer having a thickness within the range of 10 to 50 micrometers.

5. A split-type casting core adapted to be placed inside a molding cavity for defining a cored-out hollow inside a metal casting, which core comprises:

first and second core members each formed of refractory material, said first and second core members being adapted to be combined together to represent a shape complemental to the shape of the cored-out hollow, said casting core having a joint defined between the first and second core members when the first and second core members are combined together, each of said first and second core members having an exterior surface formed with:

a first coated layer made of powdery refractory material; and a second coated layer made of flaky graphite particles are formed over the first coated layer, said second coated layer having a thickness within the range of 10 to 50 micrometers, said flaky graphite particles having an average particle size within the range of 0.5 to 2 micrometers; and a sealing layer made of flaky graphite particles and formed at the joint between the first and second core members for avoiding any possible penetration of a molten metal into the casting core through such joint during a casting within the molding cavity.

* * * * *